US005634401A

United States Patent [19]

Weaver

[11] Patent Number: 5,634,401

[45] Date of Patent: Jun. 3, 1997

[54] PRINTING PRESS POWDER REMOVAL SYSTEM

[75] Inventor: Michael A. Weaver, Anderson, S.C.

[73] Assignee: Electric City Printing Company, Williamston, S.C.

[21] Appl. No.: 428,828

[22] Filed: Apr. 25, 1995

[51] Int. Cl.[6] ..... B41F 35/00

[52] U.S. Cl. ..... 101/416.1; 101/216; 101/423; 101/424.1

[58] Field of Search ..... 101/416.1, 423, 101/424.1, 425, 212, 216; 55/341.1

[56] References Cited

U.S. PATENT DOCUMENTS

| | | | |
|---|---|---|---|
| 3,053,180 | 9/1962 | Doyle | 101/416 |
| 3,410,070 | 11/1968 | Denis | 57/56 |
| 3,412,531 | 11/1968 | Schwab | 55/341 |
| 4,024,815 | 5/1977 | Platsch | 101/416 R |
| 4,176,162 | 11/1979 | Stern | 101/416.1 X |
| 4,233,901 | 11/1980 | Mallinson | 101/416 A |
| 5,115,741 | 5/1992 | Rodi | 101/424.1 |
| 5,297,873 | 3/1994 | Russell et al. | 101/424.1 X |
| 5,509,352 | 4/1996 | Kowalewski et al. | 101/232 |

OTHER PUBLICATIONS

Micro Air Air Cleaners Metal–Fab, Inc.; Wichita, Kansas.
Air–O=Vac Mechanical Air Purifier; Allentown, PA.

*Primary Examiner*—Christopher A. Bennett

*Attorney, Agent, or Firm*—Robert R. Reed; Cort Flint

[57] ABSTRACT

An offset printing press, having a raised horizontal catwalk platform along one longitudinal side, uses a spray powder to help keep them separated within a stack of sheets in a sheet discharge section of the press. Only a portion of the spray powder is used and excess spray powder is present in the air as powder-laden air. The present invention comprises a system for removal of excess spray powder from the powder-laden air and includes a containment chamber, a powder removal section and an air handling unit. The containment chamber is formed by providing first and second side panels which combine with a rear panel of the sheet discharge section to provide a general containment for removal of powder-laden air from the sheet discharge section. A downward flow of air through at least one exhaust vent into a filter unit of the powder removal section is made possible by the air handling unit. The filter unit includes at least one prefilter and at least one main filter for removal of spray powder from the powder-laden air. Clean air from the filter unit is exhausted into the print shop by the air handling unit. The powder removal section and the air handling unit are preferably placed under a top surface of the horizontal catwalk platform to save floor space in the print shop. This system is successful in removing 90–95 percent of the spray powder from the powder-laden air without adding to the heating and cooling requirements of the print shop.

35 Claims, 5 Drawing Sheets

Fig. 4.
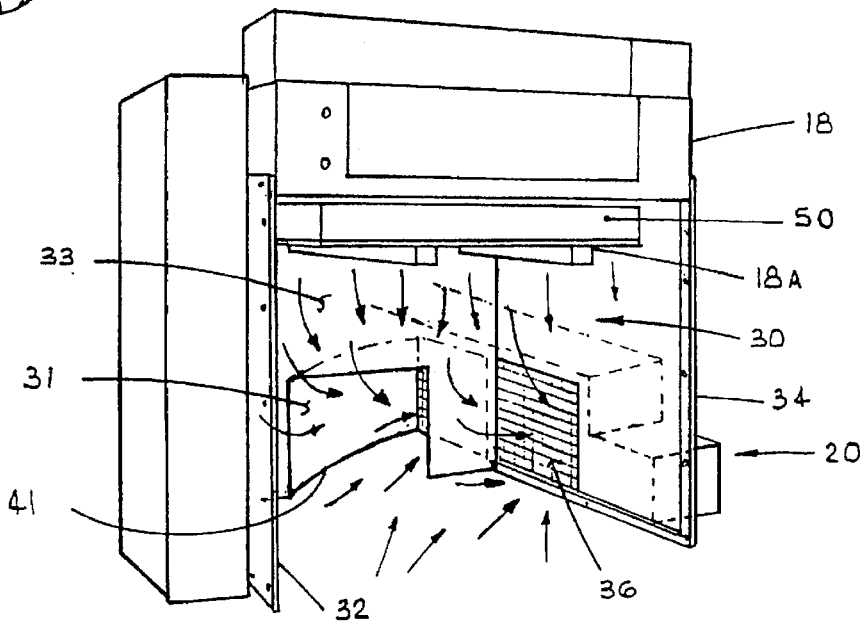
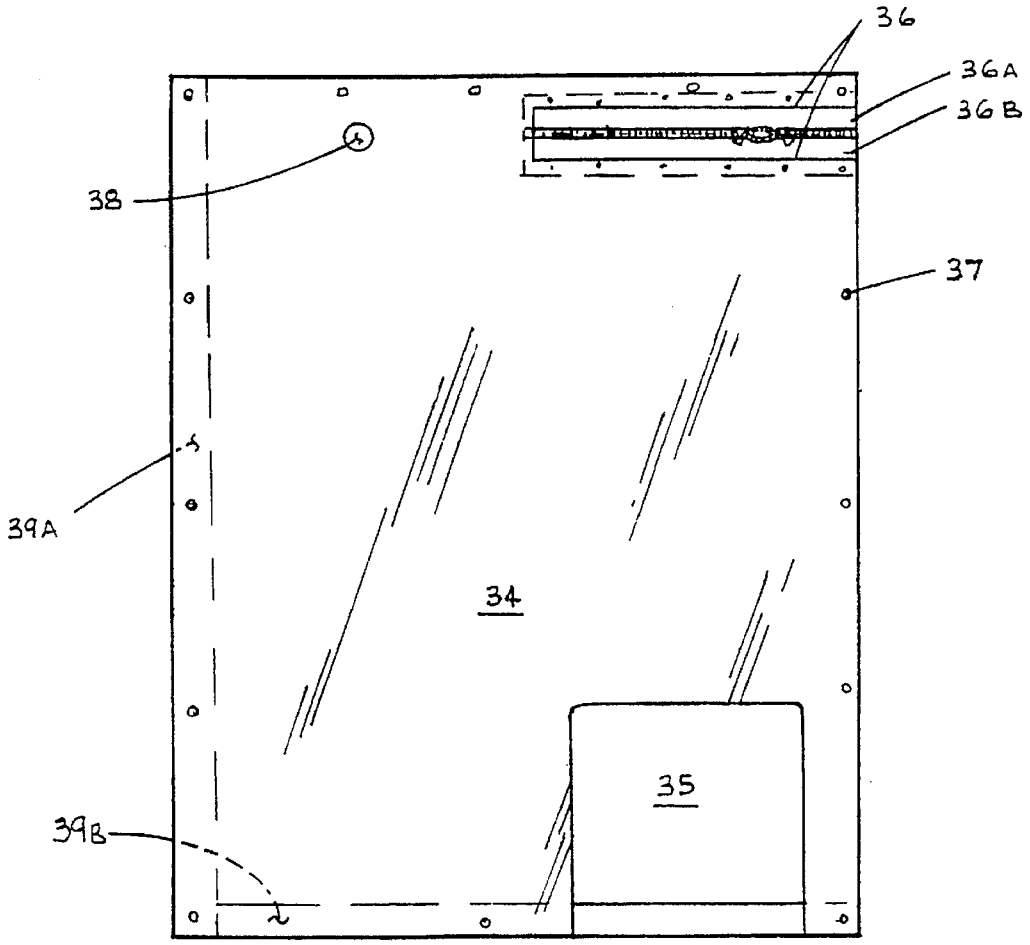
Fig. 5.

PRINTING PRESS POWDER REMOVAL SYSTEM

BACKGROUND OF THE INVENTION

This invention relates to offset printing presses, and more particularly to the removal of spray powder used to help dry the printed sheets. Some of the environmental problems associated with the spray powder in the atmosphere of a print shop are recognized and resolved.

The offset printing presses of the present time are relatively high speed machines meeting the practical requirements of high-production and quality-geared offset print shops. Some of the most sophisticated technology machines are made by Heidelberg Druckmaschinen Acktiengesellschaft of Heidelberg, Germany which uses sheet-fed offset printing. Such machines are referred to herein as "the Heidelberg". Sheets are printed at a rate of up to 12,000 sheets per hour. The requirements for transporting, printing, drying and stacking sheets are critical to achieve these fast printing speeds. The drying of the printing ink which has been applied to the individual sheets is very critical to delivering, discharging and stacking of sheets in the sheet discharge section. Problems using a spray powder on the printed sheets is the subject of this invention.

Systems for drying the printed sheets have been disclosed in U.S. Pat. Nos. 4,233,901 and 5,115,741. In U.S. Pat. No. 4,233,901 a chamber and a heater for producing a pressurized air flow to be directed onto the printed stock helps dry the stock. A further collector means for collecting the solvent mixture from the drying operation and mixing it with fresh air to recirculate through the chamber is provided. The invention of U.S. Pat. No. 5,115,741 includes a radiation device located outside the printing machine for generating radiant energy and a device to transmit this radiant energy to a surface of the printed product. An ultraviolet ink is used in the offset printing and this ink is cured by being exposed to ultraviolet light of the radiation device.

The commonly used drying means in the Heidelberg includes a spray powder device and a heater to keep the sheets from contacting one another in the stack until drying can be achieved. This spray of powder is normally introduced at the location of the sheet delivery and sheet discharge sections of the printing press. The particle size of the spray powder is sufficient to keep the ink film from transferring to the sheet above in a printed stack of sheets as the ink is drying. This allows the press to have a large stack of sheets at the sheet discharge section which are not marked. A light source is also used to electrostatically charge the spray powder particles causing them to be attracted toward the paper stock. However, not all the spray powder is used in the process and a considerable amount of powder is free in the air to penetrate other sections of the printing press as well as to exit the printing press. This free powder within the powder-laden air is trapped in cooling fans and motors, interferes with the proper lubrication of the printing press causing wear of the press parts, creates a dirty work space and is very slippery where it settles in one location. This powder-laden air can also affects the other operations of the printing company in addition to the print shop including the camera, stripping and plate rooms.

Powder spray and cleaning systems have been disclosed in U.S. Pat. Nos. 3,053,180 and 4,024,815. The system of U.S. Pat. No. 3,053,180 comprises a distributing and scavenging head structure associated with an anti-static bar to apply a spray powder to freshly printed paper and to remove all excess from the paper while preventing air transport of powder from the region of application. The head structure is contoured to fit closely to the transfer cylinders and to develop an air curtain to control the overspray of powder. The system of U.S. Pat. No. 4,024,815 is a combination spray and suction device. The device operates to spray powder in a controlled zone and to receive surplus powder by a vacuum system and return it for reuse. Once again, the system of this patent depends on providing a curtain of blast air which prevents the powder from escaping the control zone.

The control of the flow of laden air can be provided by physical barriers or devices such as those described in U.S. Pat. No. 3,410,070 and in the brochure entitled Air-O-Vac from Mechanical Air Purifiers, Inc. of Allentown, Pa. In the patent U.S. Pat. No. 3,410,070 the bobbin carriage of a textile manufacturing machine has a stream of air controlled by a flexible wall. The wall prevents an untimely release of the downward flow of air from nozzles to the outside of the machine. The flow of air eliminates "fly" in the area affected by air currents, and the air flow is exhausted without further treatment. The Air-O-Vac system incorporates a hood above the sheet delivery section of the Heidelberg for the powder-laden air that flows upward out of the sheet delivery section of the printing press. The upward movement of air is opposed to the downward movement of the sheets to reach the sheet discharge section, often resulting in sheet discharge and stacking problems. A filter bank with a motor and fan is alleged to remove 80 percent of the excess spray powder without paper flutter down to 60 lb. stock paper.

Removal of powder from powder-laden air by forcing the air through filters to collect the powder within the filter media can be an effective method. In U.S. Pat. No. 3,412,31 the removal of dirt from the air circulation system is by substantially tubular elements with straight walls which taper at their end. These elements are referred to in the present technology as "bag filters" which have a high average efficiency in the removal of particles from the air. For example, the Micro Air air cleaners manufactured by Metal-Fab, Inc. of Wichita, Kans. use an 8-pocket bag filter along with a pre-filter to achieve high average efficiency filters.

Present systems for removal of the powder from powder-laden air do not achieve the efficiency or effectiveness necessary for the printing press of the Heidelberg type. The need continues to remove powder from the powder-laden air below the sheet delivery section where the sheet discharge section is located. This section has powder-laden sheets in a vertical stack. The need exists to create an improved air flow direction within the sheet discharge section and to provide at least one exhaust vent properly located within the sheet discharge section.

Accordingly, an object of the present invention is to provide a system to remove the spray powder from the powder-laden air created by the printing press. In particular, the invention is to provide clean air to be exhausted back into the press shop without interferring with the delivery of the printed paper or without unduly consuming floor space.

Another object of the present invention is to help eliminate contaminates in the shop air that get into the printing press ink and cause the printed materials to be flawed.

Yet another object of the present invention is to provide a cleaner and healthier place to work and to cut down on the maintenance of the printing press equipment within the press room including the room air conditioning and heating systems. This object includes saving energy costs for heating and air conditioning the press shop by not exhausting the powder-laden air to the outside.

SUMMARY OF THE INVENTION

The above objectives are accomplished according to the present invention by a system including a containment chamber a powder removal section and an air handling unit. Spray powder is removed from the powder-laden air by slowly forcing the air through at least one pre-filter and a main filter including an air bag filter. Clean air is exhausted to ambient such that no additional heating and cooling requirements of the print shop are required.

In particular, the invention includes a system for removing excess spray powder in an offset printing press. The printing press has a sheet feeder section for feeding stock sheets through at least one printing unit which receives and prints the sheets. A sheet delivery section transfers printed sheets from a last of the printing units and has a powder spraying device for dispensing powder on the printed sheets and a heater for drying the printed sheets while being transferred. A sheet discharge section adjacent the sheet delivery section is for receiving the discharged sheets from the sheet delivery section. The printing press has a length generally defined by the sheet feeder section, at least one printer unit, the sheet delivery section and the sheet discharge section being disposed in series. A raised horizontal catwalk platform is disposed adjacent an exterior of the printing press along at least a portion of the printing press length for servicing the printing press.

The system comprises a containment chamber formed within the sheet discharge section which includes a first side panel arranged on one side of the sheet discharge section and a second side panel arranged on an opposite side of the sheet discharge section to provide a general containment for removal of powder-laden air from the sheet discharge section. The system further comprises a powder removal section for removing powder from the powder-laden air including a filter unit located below the horizontal catwalk platform and connected with the containment chamber to receive powder-laden air and to filter the air. The filter unit has at least a first pre-filter and at least one main filter disposed downstream of the pre-filter to substantially remove spray powder from the powder-laden air to provide essentially clean air. An air handling unit is in flow communication with the containment chamber and the powder removal section to establish an air flow through at least the containment chamber and the powder removal section to convey the powder-laden air for powder removal and exhaust the clean air to ambient.

In another embodiment the system includes an air flow duct defined by a top surface of the horizontal catwalk platform, a front panel having at least one door portion which can be displaced to access the filters. The air duct includes a rear longitudinal panel and a floor surface area. The air flow duct generally encloses the filter unit and the air handling unit for channeling of the powder-laden air and clean air. The horizontal catwalk platform is located to be used for servicing the printing press.

In a further embodiment the filter unit is disposed adjacent the first side panel of the containment chamber. An exhaust vent is included in the first side panel which allows powder-laden air to enter a plenum of the filter unit through the first pre-filter. The first pre-filter and the main filters collect the excess spray powder and the filters are capable of being removed from the location of the printing press while being cleaned.

DESCRIPTION OF THE DRAWINGS

The construction designed to carry out the invention will hereinafter be described, together with other features thereof. The system for the invention will be more readily understood from a reading of the following specification and by reference to the accompanying drawings forming a part thereof, wherein an example of the invention is shown and wherein:

FIG. 4 is a perspective view of the sheet discharge section of the printing press illustrating the downward flow of powder-laden air going into an exhaust vent as well as an alternate rear vent and duct of the system of this invention.

FIG. 5 is an elevation view of the first side panel of this invention showing the location and details of an exhaust port and other control openings as well as locations for attachment of the panel to the printing press;

DESCRIPTION OF A PREFERRED EMBODIMENT

Figure 1:
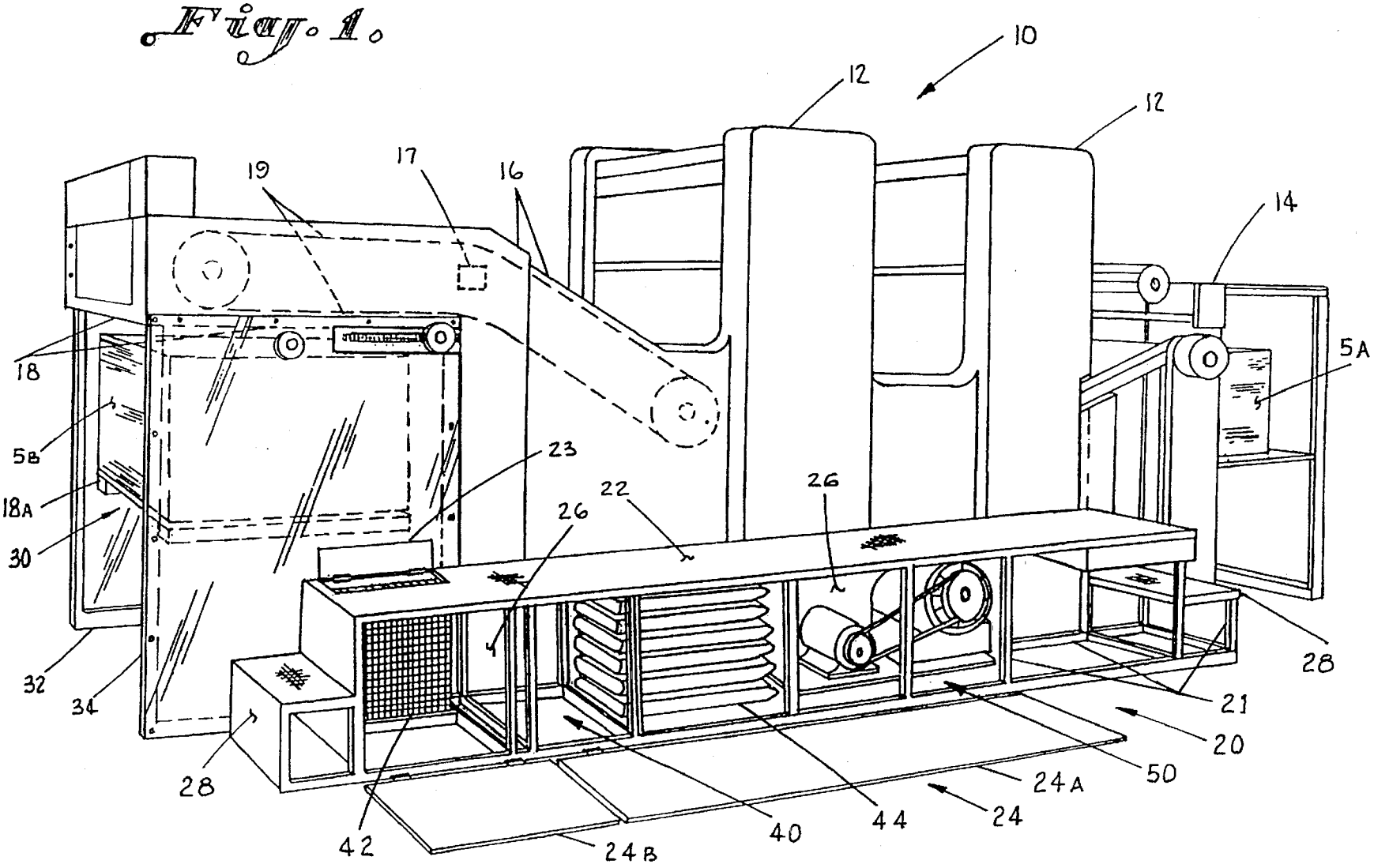
FIG. 1 is a perspective view of the printing press showing the preferred system for removing excess spray powder according to this invention.

Referring now in more detail to the drawings, the invention will now be described in more detail. The system for removal of excess spray powder in an offset printing press is illustrated in FIG. 1. A large stack 5A of unprinted sheets is placed in the sheet feeder section 14 at one end of the printing press 10. Sheet transport is effected longitudinally along a transfer path through the length of the press. The sheets feed into the first of a series of printing units. These printing units have a number of components including coating pans, coating blanket cylinders, impression cylinders, spray water tubes and blower tubes. Transfer drums are arranged between printing units to convey sheets from one printing unit to the next. Typically, each printing unit adds another color to the sheet being printed. The printing press 10, illustrated in FIG. 1, would have two colors in addition to the normal black ink. The printed sheets are transferred from the last printing unit of the series to a sheet delivery section 16 having a conveyor device 19 with grips to grab the sheets and transfer them to the next section. This chain driven sheet delivery section conveys the printed sheets to a sheet discharge section 18. A pile hoist 18A in the sheet discharge section 18 receives the printed sheets to form a printed stack 5B of sheets. The printing press can print 8,000 to 12,000 sheets per hour. Access to the printing units and other sections of the printing press is provided by a raised horizontal catwalk section 20 along one longitudinal side of the press. This section has a framework 21 supporting the top surface 22 of the catwalk platform 20 above a floor area which is accessed by a single step 28 at each end.

An important process within the sheet delivery section 16 is the application of a spray powder by a spray powder device 17. The powder explodes in a fine mist into the air to float onto the individual sheets. The spray powder helps to separate the sheets and keeps the ink from transferring from one sheet to the sheet above in the stack 5B of sheets. The powder is a non-offset spray powder being a starch typical in the industry. A typical starch is powder 300-0X supplied by Printers Service Co. of Newark, N.J. The transfer of spray powder to the sheets is further assisted by a light source that electrostatically charges the powder to be attracted to the printed sheet.

The removal of excess spray powder from the drying and stacking of printed sheets from the printing press is solved by the system of this invention. The advantages of having an effective system for removal of excess spray powder are discussed in more detail later in this disclosure. A containment chamber 30 is provided, as illustrated in FIG. 1, by adding a first side panel 34 and a second side panel 32 attached to the sheet discharge section 18 of the press. The containment chamber is in an air flow relationship with a powder removal section 40 and an air handling unit 50. The powder removal section removes the spray powder from the powder-laden air when the air handling unit produces a flow of air through the system. The powder removal section 40 has at least a pre-filter and a at least one main filter. The preferred main filter is a plurality of air bag filters 44 to help provide clean air to be discharged to ambient air. A single pre-filter 42 can be provided or a plurality of pre-filters can be used to increase the efficiency of the system.

The system is preferably designed to conserve floor space in the print shop by using the raised horizontal catwalk platform 20 to locate the powder removal section 40 and the air handling unit 50, as illustrated in FIG. 1. The top surface 22 of the catwalk platform 20 provides the top portion, a rear longitudinal panel 26 forms the back portion, a front panel 24 accessible from the shop area forms the front portion and the underlying floor area provides the bottom portion of an air flow duct of the system. The front panel 24 preferably has two doors. A first front door 24A allows access to the air handling unit 50 and a second front door 24B allows access to the powder removal section 40. Other doors can be provided to allow access to the individual components. A filter access door 23 provides for installation and removal of a first pre-filter 42.

Figure 2:
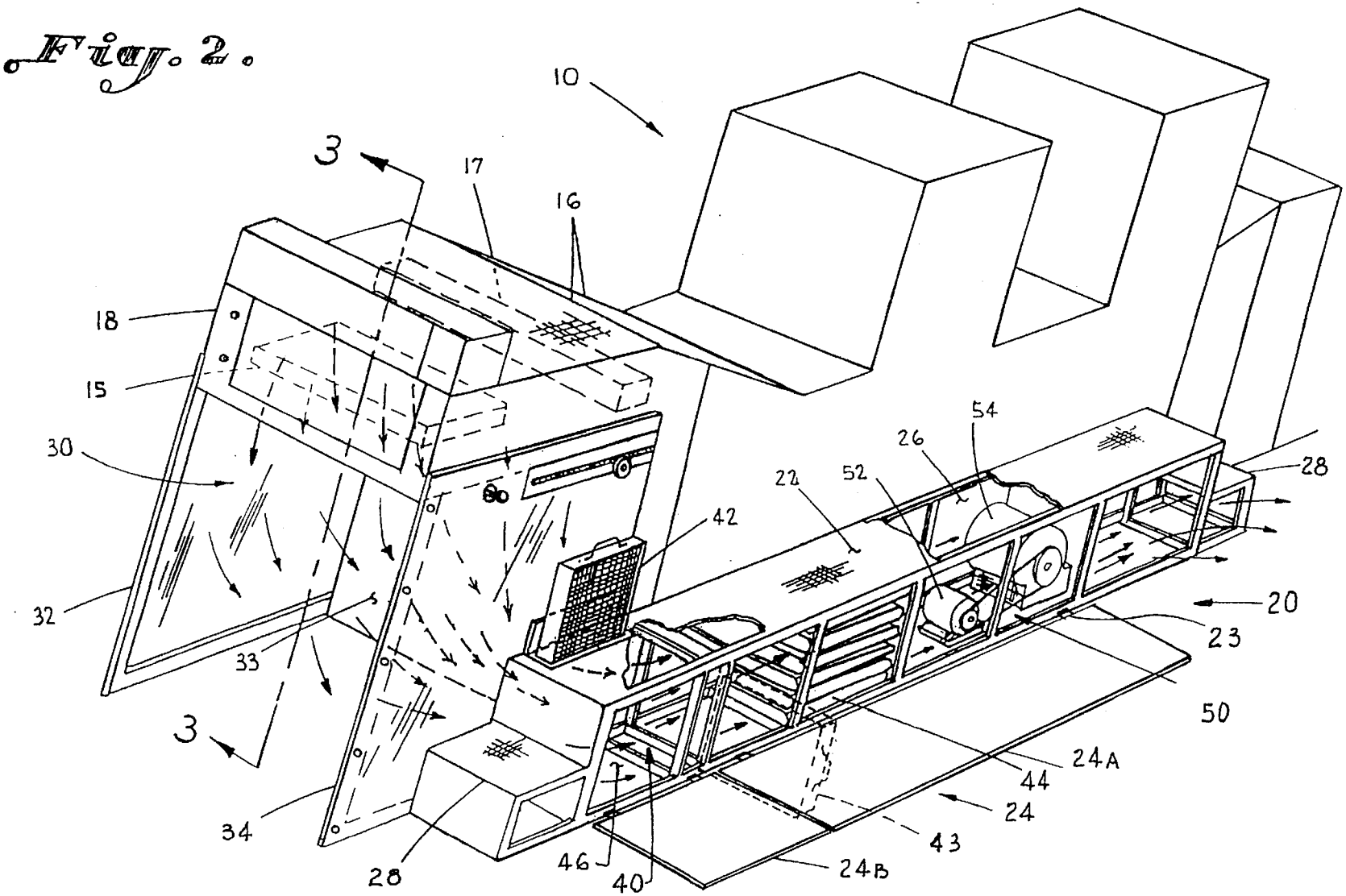
FIG. 2 is a perspective view of the system for removing excess spray powder including an indication of the air flow through the system and the provisions for placement of first and second pre-filters according to this invention.
Figure 3:
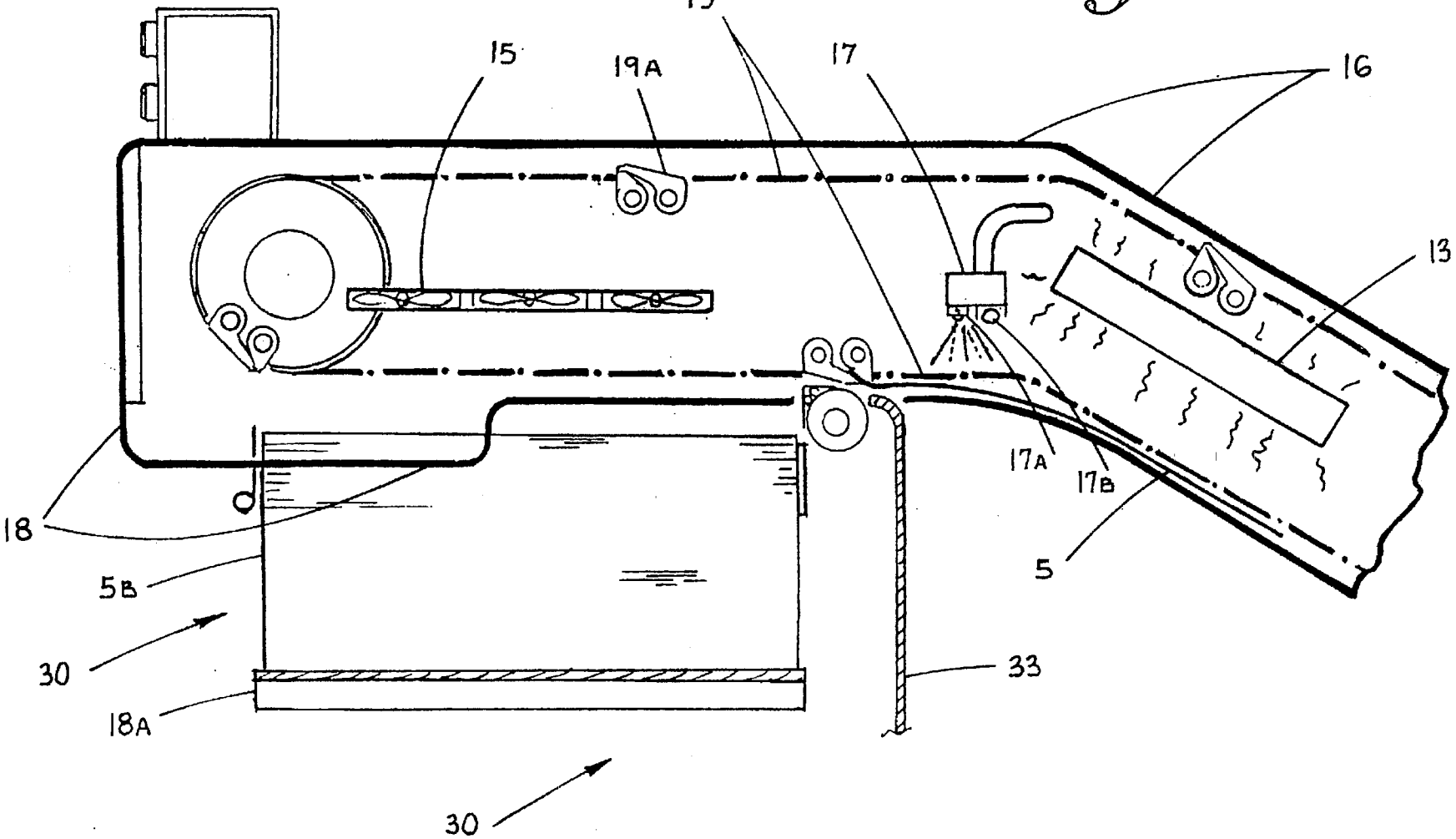
FIG. 3 is a cross-section view of the sheet delivery section of the printing press cut along line 3—3 in FIG. 2 showing spray powder being applied to a sheet of paper and a stack of printed sheets.

A fan unit 15 in the sheet discharge section 18 of the printing press 10 helps transfer the sheets to the pile hoist below, as illustrated in FIGS. 2 and 3. FIG. 3 is a cross-section view cut along line 3—3 in FIG. 2. Upstream of the fan unit, within the sheet delivery section 16, the powder spray device 17 has added spray powder to the air to obtain powder-laden air that separates the printed sheets. A heater 13 also helps dry the printed sheet, as illustrated in FIG. 3. The powder spray device includes a spray head 17A and a light source 17B to electrostatically charge the printed sheet 5 as it is being transported by the conveyor device 19. Conveyor sheet clamps 19A pull the printed sheets through the sheet delivery section 16 to the sheet discharge section 18.

The system of this invention provides for a downward flow of air in the containment chamber 30 as illustrated in FIG. 2. The pile hoist and printed stack of sheets have been removed in FIG. 2 to better illustrate the flow of air in the containment chamber. The containment chamber 30 is formed in the sheet discharge section by the first and second side panels 34 and 32 of this invention; as well as the rear panel 33 of the sheet discharge section 18. The powder-laden air is forced downward in the containment chamber into a plenum 46 of the powder removal section 40. The first pre-filter 42 may be positioned in the flow of air as the powder-laden air enters the plenum. A second pre-filter 43 may also be added in the plenum in a downstream relationship with the first pre-filter to help remove spray powder from the powder-laden air. The second pre-filter is preferably accessed by the second door 24B of the front panel 24. The main filter preferably being a plurality of air bag filters 44 is placed further downstream in the flow of air to complete the removal of spray powder and provide clean air to be discharged to ambient by the air handling unit 50. Preferably the air handling unit comprises a motor 52 and a discharge fan 54 to force the flow of air through the system. The first door 24A of the front panel 24 allows access to the air handling unit 50.

The primary flow of air from the containment chamber 30 is by way of a first exhaust vent 35, as illustrated in FIG. 4. In another embodiment of the invention a second path of air flow is achieved by providing a rear exhaust vent 31 in the rear panel 33 of the containment chamber 30. The first and second side panels 34 and 32 are critical elements for developing the containment chamber 30. The pile hoist 18A of the sheet discharge section 18 is shown with a short stack 5C of printed sheets. The result is a larger volume within the containment chamber to be evacuated. Therefore, a second exhaust vent being the rear exhaust vent 31 is desirable. The raised horizontal catwalk platform 20 provides a floor area adjacent to both exhaust vents for location of the powder removal section, as previously illustrated. A rear duct 41 directs the flow of air from the rear exhaust vent 31 to the powder removal section under the horizontal catwalk platform 20.

Construction of the first side panel 34 provides for an exhaust port 35 as well as first and second control openings 36 and 38 for operation of the control handles of the sheet discharge section from the exterior of the press, as illustrated in FIG. 5. A first control opening 36 is elongated to provide for the movement of a respective control handle. Two cover portions 36A and 36B are provided to close the opening except for the shaft of the respective control handle. Preferably these cover portions are joined by a double zipper arrangement to position the opening at a proper location. The side panels are preferably made of a clear sheet of plastic supported at their edge by edge support rails 39A and 39B. Any suitable material that provides containment of the powder-laden air on the two lateral sides is within the scope of this invention. The side panels are attached to the sheet discharge section of the press at locations 37; shown as small circles on FIG. 5.

Figure 6:
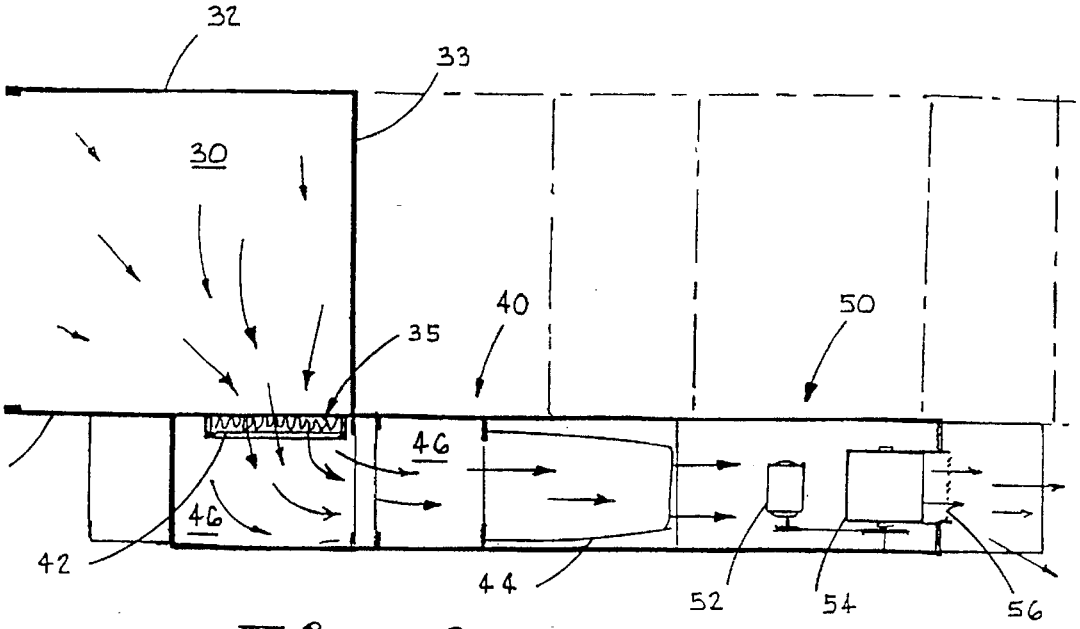
FIG. 6 is a schematic plan view of a preferred embodiment of the invention showing the flow of air through the system.

In the preferred embodiment of the invention illustrated in FIG. 6 the flow of powder-laden air from the containment chamber 30 flows through a first exhaust vent 36 into a plenum 46 of the powder removal section 40. Once again, the containment chamber 30 is formed by first and second side panels 34 and 32 along with rear panel 33° A pre-filter 42 is located near the first exhaust vent to initially remove a portion of the spray powder from the powder-laden air. The partially cleaned powder-laden air within the plenum continues to flow from the plenum 46 through at least one main filter which preferably includes a plurality of air bag filters 44. Clean air coming from the bag filters is exhausted by the air handling unit 50 through and exhaust grill 56. A motor 52 and a fan 54 are included in the preferred air handling unit 50.

Figure 7:
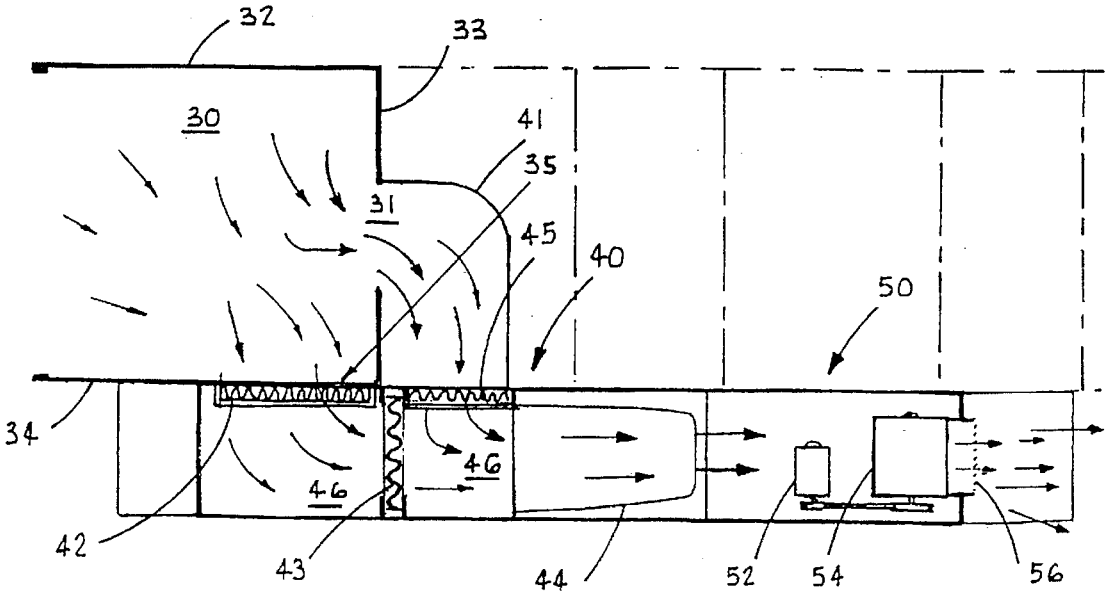
FIG. 7 is a schematic plan view of the alternate embodiment of the invention including an alternate flow of air through the system.

In another embodiment of the invention an improved flow of air and an improved pre-filter arrangement is provided for extreme conditions of excess spray powder as well as a larger free air volume in the containment chamber 30. This embodiment is illustrated in FIG. 7. A rear exhaust vent 31 is provided in addition to the first exhaust vent 36. A portion of the powder-laden air flows through a rear duct 41 before entering the plenum 46 of the powder removal section 40. A third prefilter 45 is placed in the flow of air coming into the plenum. The third pre-filter 45 in addition to the first pre-filter 42 removes spray powder from the powder-laden air before it flows through the at least one main filter. The at least one main filter is preferably a plurality of air bag filters 44, as before, to provide clean air to be discharged by the air handling unit 50. The air handling unit once again includes a motor 52 and a fan 54 that discharges clean air to the atmosphere through an exhaust grill 56. A further embodiment includes locating a second pre-filter 43 in an air flow relationship between the first pre-filter and the main filter.

The preferred motor 52 is a standard 240 volt three phase AC motor of approximately 2–4 horse power and the preferred fan 54 is the squirrel-cage type being approximately 10–12 inches in diameter. The fan is operated to move the air through the system with only enough velocity to control the flow of powder-laden air and clean air through the system. The preferred capacity of the fan is approximately 3500–5000 cubic feet per minute.

The pre-filters are made using a filter medium standard in the industry. The filter medium should be sufficient to remove starch particles from the air. The main filter completes the removal of spray powder up to 90–95 percent removal of the spray powder in the powder-laden air. The preferred main filter is an S-pocket pleat bag filter of sufficient length (say 30 inches) to remove particles in the air of one micron or larger. Air bag filters are also standard in the industry.

Other embodiments of the present invention include locating the air handling unit 50 at a remote location from the powder removal section 40. The plenum may also be reduced in size if the second and third pre-filters are not provided. A critical embodiment is to locate the powder removal section 40 near the containment chamber 30 adjacent to the printing press 10 such that the floor space in the print shop can be conserved for other operational uses.

The system of the present invention offers many advantages for the printing company having offset printing presses as follows:

1. It helps eliminate contaminates that get into the printers ink and cause "hickeys".
2. It helps eradicate dust in the print shop as well as the camera, stripping and plate rooms.
3. It makes the print shop a cleaner and healthier place to work.
4. It improves equipment down time by reducing required maintenance of press room mechanical components.
5. It removes 90–95 percent of the excess spray powder from the powder-laden air.
6. It establishes air velocities in the proper direction and with a reduced magnitude that eliminates flutter of the paper sheets within the printing press.
7. It exhausts clean air to the print shop to save the cost of heating and cooling air required for a makeup air unit.
8. It provides a fast and easy means to access the filters for periodic replacement and cleaning.
9. It saves floor space by locating sections and units of the system to utilize the space associated with the raised horizontal catwalk platform.
10. It saves electrical hookup costs by using the same power supply and electrical panels as those used by the printing press.
11. It uses an exhaust air velocity that does not disturb other operations within the print shop.

While a preferred embodiment of the invention has been described using specific terms, such description is for illustrative purposes only, and it is to be understood that changes and variations may be made without departing from the spirit or scope of the following claims.

What is claimed is:

1. A system in combination with an offset printing press for removing excess spray powder in said offset printing press; said printing press having a sheet feeder section for feeding stock sheets through at least one printing unit which receives and prints said sheets; a sheet delivery section to transfer printed sheets from a last of said printing units having a powder spraying device for dispensing powder on said printed sheets and a heater for drying said printed sheets while being transferred; a sheet discharge section adjacent said sheet delivery section for receiving said discharged sheets from said sheet delivery section; said printing press having a length defined generally by said sheet feeder section, at least one printer unit, sheet delivery section, and sheet discharge section being disposed in series; and a raised horizontal catwalk platform disposed adjacent an exterior of said printing press along at least a portion of said printing press length for servicing of said printing press, said system comprising:

a containment chamber formed within said sheet discharge section which includes a first side panel arranged on one side of said sheet discharge section, and a second side panel arranged on an opposite side of said sheet discharge section to provide a general containment for removal of powder-laden air from said sheet discharge section;

a powder removal section for removing powder from said powder-laden air including a filter unit located below said horizontal catwalk platform and connected to said containment chamber to receive said powder-laden air and filter said air;

said filter unit having at least a first pre-filter and at least one bag filter disposed downstream of said pre-filter to substantially remove said spray powder from said powder-laden air to provide essentially clean air; and an air handling unit in air flow communication with said containment chamber and said powder removal section to establish an air flow through at least said containment chamber and said powder removal section to convey said powder-laden air for powder removal and exhaustion of said clean air to ambient.

2. The system set forth in claim 1, including an air flow duct defined by a top catwalk portion of said horizontal catwalk platform, a front panel having at least one door portion which can be displaced to access said filters, a rear longitudinal panel and a floor surface area, said air flow duct generally enclosing said filter unit and said air handling unit for channeling of the powder-laden air and clean air, said horizontal catwalk platform being further located to be used for servicing said printing press.

3. The system set forth in claim 1, wherein said filter unit has a plenum in a downstream air flow relationship with said containment chamber for directing said flow of air through said at least one pre-filter and for changing the direction of the flow of air to directly enter said at least one bag filter.

4. The system set forth in claim 1, wherein said filter unit and said air handling unit are positioned generally at a floor level in cooperation with an exhaust vent disposed in a lower portion of said containment chamber to establish a downward flow of air from said sheet discharge section.

5. The system set forth in claim 1, wherein said filter unit is disposed adjacent said first side panel of said containment chamber, and including an exhaust vent in said first side panel which allows said powder-laden air to enter a plenum of said filter unit through said first pre-filter, wherein said first pre-filter and said bag filter collect said excess spray powder, said filters capable of being removed from the location of the printing press while being cleaned.

6. The system set forth in claim 5, including a second pre-filter in said plenum between said first pre-filter and said bag filter to help remove said spray powder from said powder-laden air.

7. The system set forth in claim 1, wherein said first side panel is disposed adjacent to said filter unit and has an exhaust vent at a location adjacent a floor area to allow said powder-laden air to flow downward to said filter unit from said containment chamber.

8. The system set forth in claim 7, wherein said first side panel further has first and second control openings for receiving control handles of said sheet pile hoist of the sheet discharge section for operation from the exterior of said press.

9. The system set forth in claim 7, wherein said containment chamber further includes a rear exhaust vent disposed in a rear panel of said sheet discharge section, said rear panel being another side of said containment chamber, and an air duct going from said rear exhaust vent to a plenum of said filter unit, wherein said rear exhaust vent and said air duct provide another path for the flow of powder-laden air to said air filter.

10. The system set forth in claim 9, including a third pre-filter placed in the path of powder-laden air flowing into said filter unit from said rear exhaust vent to partially remove said spray powder from said powder-laden air before it flows into said plenum area of said filter unit.

11. A system for adapting an offset printing press so that excess spray powder may be removed from said offset printing press; said printing press having a sheet feeder section for feeding stock sheets through at least one printing unit which receives and prints said sheets; a sheet delivery section to transfer printed sheets from a last of said printing units having a powder spraying device for dispensing powder on said printed sheets and a heater for drying said printed sheets while being transferred; a sheet discharge section adjacent said sheet delivery section for receiving said discharged sheets from said sheet delivery section; said printing press having a length defined generally by said sheet feeder section, at least one printer unit, sheet delivery section, and sheet discharge section being disposed in series; and a raised horizontal catwalk platform disposed adjacent an exterior of said printing press along at least a portion of said printing press length for servicing of said printing press, wherein said system comprises:

at least a first side panel arranged on one side of said sheet discharge section to provide a general containment chamber for removal of powder-laden air from said sheet discharge section;

a powder removal enclosure section adapted for connection to said containment chamber to receive said powder-laden air for removing said powder from said powder-laden air;

an air handling unit adapted for being disposed in air flow communication with said containment chamber and said powder removal section to establish an air flow through at least said containment chamber and said powder removal section and to convey said powder-laden air for powder removal and exhaustion of said clean air to ambient.

12. The system set forth in claim 11, wherein said air handling unit is disposed to receive clean air from said powder removal section and to force said clean air to the atmosphere through an exhaust grill.

13. The system set forth in claim 12, wherein a power supply of said air handling unit comprises an electrical motor and an air movement device of said air handling unit comprises a fan, said fan is operated to establish a negative air pressure in said containment chamber and a negative pressure gradient continuing through said system to force the powder-laden air through said powder removal section and said clean air through said fan.

14. The system set forth in claim 11, wherein said powder removal enclosure section is positioned near a floor area in cooperation with said catwalk platform, said enclosure section including an exhaust vent disposed near a lower portion of said containment chamber to establish a downward flow of air through said sheet discharge section.

15. The system set forth in claim 11, wherein said first side panel is attached to a side of said sheet discharge section and has an exhaust port at a location adjacent a floor area to communicate with said powder removal enclosure section for allowing said powder-laden air to flow downward and into a plenum of said filter unit from said confinement chamber.

16. The system set forth in claim 15, wherein said first side panel further has first and second control openings for control handles of said sheet pile hoist of the sheet discharge section to be made accessible from the exterior of said press.

17. The system set forth in claim 16 wherein said second control opening has a two part cover attached to said first side panel to limit the amount of open area between the containment chamber and the atmosphere to an area only large enough for an operating shaft of a respective control handle, said two part cover having a slot to permit said shaft to be adjusted laterally within said second opening.

18. A system in combination with an offset printing press for removing excess spray powder in said offset printing press; said printing press having a sheet feeder section for feeding stock sheets through at least one printing unit which receives and prints said sheets; a sheet delivery section to transfer printed sheets from a last of said printing units having a powder spraying device for dispensing powder on said printed sheets and a heater for drying said printed sheets while being transferred; a sheet discharge section adjacent said sheet delivery section for receiving said discharged sheets from said sheet delivery section; said printing press having a length defined generally by said sheet feeder section, at least one printer unit, sheet delivery section, and sheet discharge section being disposed in series; and a raised horizontal catwalk platform disposed adjacent an exterior of said printing press along at least a portion of said printing press length for servicing of said printing press, said system comprising:

a containment chamber formed within said sheet discharge section to form a general containment for removal of powder-laden air from said sheet discharge section;

a powder removal section which includes a filter unit located below said horizontal catwalk platform connected to said containment chamber for receiving said powder-laden air and filtering said air;

said filter unit having at least one main filter disposed downstream of said containment chamber to substantially remove said spray powder from said powder-laden air to provide substantially clean air; and an air handling unit in air flow communication with said containment chamber and said powder removal section to establish an air flow through at least said containment chamber and said powder removal section for powder removal and exhaustion of said clean air to ambient.

19. The system set forth in claim 18, including an air flow duct defined at least in part by said horizontal catwalk platform, a front panel having a door portion which can be displaced to access said filter unit, a rear longitudinal panel and a floor surface area; said air flow duct generally enclosing said filter unit for channeling of the powder-laden air; and said horizontal catwalk platform being further located to be used for servicing said printing press.

20. The system set forth in claim 18, wherein said filter unit has a plenum downstream from said containment chamber for changing the direction of the flow of air to directly enter said main filter.

21. The system set forth in claim 18, wherein said filter unit is positioned near a floor area and a first exhaust vent is disposed near a lower portion of said containment chamber so that a downward flow of air is established through said sheet discharge section into said filter unit.

22. The system set forth in claim 21, including a rear exhaust vent upstream of said filter unit in fluid communication with said containment chamber to help with said downward flow of powder-laden air into said filter unit.

23. The system set forth in claim 22, wherein a first pre-filter is positioned in the path of said air flow through said first exhaust vent, and a third pre-filter is positioned in the path of said air flow through said rear exhaust vent to help remove said spray powder from said powder-laden air.

24. The system set forth in claim 23, wherein a second pre-filter is positioned in the path of air between said first pre-filter and said at least one main filter to further help remove said spray powder from said powder-laden air.

25. The system set forth in claim 18, including a rear panel which generally encloses a rear portion of said sheet discharge section to further provide said containment chamber; and a rear exhaust vent being formed in said rear panel in fluid communication with said filter unit.

26. The system set forth in claim 25, including a pre-filter placed in the path of powder-laden air flowing into said filter unit to help remove said powder from said powder-laden air before it flows into said at least one main filter.

27. A system in combination with an offset printing press for removing excess spray powder in said offset printing press; said printing press having a sheet feeder section for feeding stock sheets through at least one printing unit which receives and prints said sheets; a sheet delivery section to transfer printed sheets from a last of said printing units having a powder spraying device for dispensing powder on said printed sheets and a heater for drying said printed sheets while being transferred; a sheet discharge section adjacent said sheet delivery section for receiving said discharged sheets from said sheet delivery section; said printing press having a length defined generally by said sheet feeder section, at least one printer unit, sheet delivery section, and sheet discharge section being disposed in series; and a raised horizontal catwalk platform disposed adjacent an exterior of said printing press along at least a portion of said printing press length for servicing of said printing press, said system comprising:

a containment chamber formed within said sheet discharge section to provide a general containment for removal of powder-laden air from said sheet discharge section;

an exhaust vent disposed in said containment chamber for exhausting powder-laden air from said containment chamber;

a powder removal section connected to said exhaust vent to receive said powder-laden air for removing said spray powder from said powder-laden air and for discharging clean air;

an air handling unit in air flow communication with said containment chamber and said powder removal section to establish an air flow through said exhaust vent and through said powder removal section for powder removal and exhaustion of said clean air to ambient; and said exhaust vent being disposed in said containment chamber so that said air flow is established in a downward direction in said containment chamber.

28. The system set forth in claim 27, wherein said powder removal section is disposed under said horizontal catwalk platform.

29. The system set forth in claim 27, wherein said powder removal section and said air handling unit are positioned near a floor area in cooperation with said exhaust vent being in the lower portion of said containment chamber.

30. The system set forth in claim 29, including a plenum downstream from said exhaust vent for directing said flow of air through at least one main filter.

31. The system set forth in claim 30, including a pre-filter placed in the path of the powder-laden air flow upstream from said at least one main filter to partially remove spray powder from said powder-laden air before it flows into said at least one main filter.

32. The system set forth in claim 30, wherein said at least one main filter includes a plurality of bag filters which provide clean air to be discharged to ambient by said air handling unit.

33. The system set forth in claim 27, including a rear exhaust vent formed in a rear portion of said containment chamber in air flow communication with said powder removal section.

34. The system set forth in claim 33, including a rear air duct going from said rear exhaust vent to said powder removal section so that said rear exhaust vent and said rear air duct provide and alternate flow of powder-laden air to be exhausted from said containment chamber.

35. The system set forth in claim 34, wherein a pre-filter is placed in the path of powder-laden air flowing into said powder removal section from said rear exhaust vent to help remove said spray powder from said powder-laden air upstream of a main filter.

* * * * *